US010464737B2

(12) United States Patent
Burgals et al.

(10) Patent No.: US 10,464,737 B2
(45) Date of Patent: Nov. 5, 2019

(54) RECEPTACLE FOR STORING A SUBSTANCE

(71) Applicant: SIKA TECHNOLOGY AG, Baar (CH)

(72) Inventors: Frédéric Burgals, Le Pradel (FR); Christophe Rayssiguier, Rousson (FR)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 15/775,258

(22) PCT Filed: Nov. 25, 2016

(86) PCT No.: PCT/EP2016/078891
§ 371 (c)(1),
(2) Date: May 10, 2018

(87) PCT Pub. No.: WO2017/089584
PCT Pub. Date: Jun. 1, 2017

(65) Prior Publication Data

US 2018/0327175 A1 Nov. 15, 2018

(30) Foreign Application Priority Data

Nov. 25, 2015 (EP) ..... 15196271

(51) Int. Cl.
*B65D 83/48* (2006.01)
*B65D 83/34* (2006.01)
*B65D 83/38* (2006.01)

(52) U.S. Cl.
CPC ..... *B65D 83/48* (2013.01); *B65D 83/34* (2013.01); *B65D 83/382* (2013.01)

(58) Field of Classification Search
CPC ..... B65D 83/48
USPC ..... 222/81, 82, 394, 402.21–402.23
See application file for complete search history.

(56) References Cited

U.S. PATENT DOCUMENTS 3,318,484 A 5/1967 Modderno
3,441,177 A * 4/1969 Treharne, Jr. ..... B65D 83/48 222/402.16
3,648,899 A 3/1972 Lukesch et al.
4,171,757 A * 10/1979 Diamond ..... B65D 83/64 222/389
4,493,444 A * 1/1985 Del Bon ..... B65D 83/207 222/402.22

(Continued)

FOREIGN PATENT DOCUMENTS

CA 1165741 A 4/1984
WO 81/03318 A1 11/1981

(Continued)

OTHER PUBLICATIONS

Feb. 1, 2017 International Search Report issued in International Patent Application No. PCT/EP2016/078891.

(Continued)

*Primary Examiner* — Vishal Pancholi
(74) *Attorney, Agent, or Firm* — Oliff PLC

(57) ABSTRACT

A receptacle for storing a substance, wherein the receptacle has a cartridge and a valve. A valve inner side is here covered by a sealing element, with the result that a receptacle volume is substantially delimited by the cartridge and the sealing element.

15 Claims, 3 Drawing Sheets

(56) References Cited

U.S. PATENT DOCUMENTS

Figure 1:
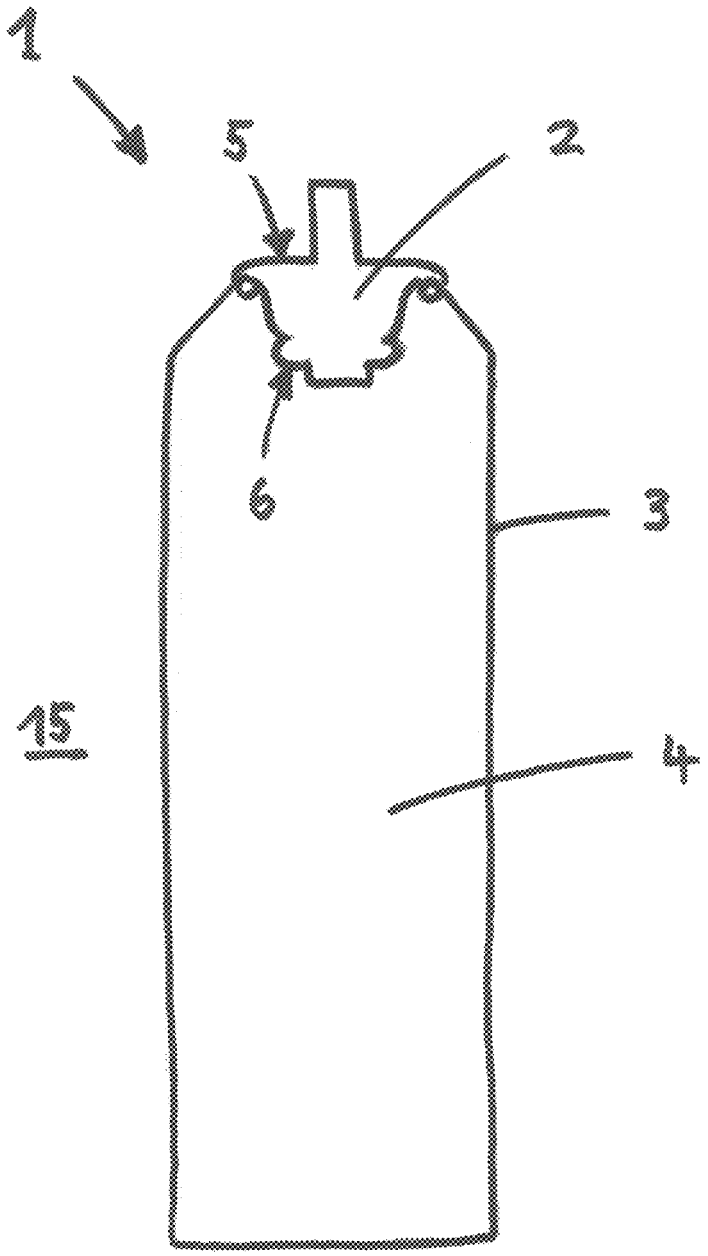

| | | | | |
|---|---|---|---|---|
| 4,651,899 | A * | 3/1987 | Pauls | B65D 81/32 215/DIG. 8 |
| 5,064,121 | A | 11/1991 | Bolduc | |
| 5,456,386 | A * | 10/1995 | Jesswein | B65D 83/687 222/136 |
| 2012/0168460 | A1 | 7/2012 | Tolstykh | |
| 2016/0296959 | A1 * | 10/2016 | Yamaguchi | A45D 34/02 |

FOREIGN PATENT DOCUMENTS

| | | | |
|---|---|---|---|
| WO | 2012/024290 | A1 | 2/2012 |
| WO | 2015/080252 | A1 | 6/2015 |

OTHER PUBLICATIONS

May 29, 2018 International Preliminary Report on Patentability issued in International Patent Application No. PCT/EP2016/078891.

Mar. 28, 2019 Office Action issued in Chinese Patent Application No. 201680068900.7.

* cited by examiner

RECEPTACLE FOR STORING A SUBSTANCE

The present invention relates to a receptacle for storing a substance and to a method for sealing a receptacle.

To store substances, such as, for example, adhesives or sealants, use is made of cartridges which are closed on one side. Such cartridges can be formed from metal or plastic. Here, a volume of the cartridges is completely delimited by the material from which the cartridge is formed. To open the cartridge, a predefined region of the cartridge wall is customarily breached. In order to apply the substance in the cartridge, a nozzle can be mounted over the opening in the cartridge wall. A thread is customarily provided on the cartridge for this purpose.

Such cartridges have the advantage that the substance is able to be stored very well until the cartridge is opened. Suitable selection of the material from which the cartridge is formed makes it possible to achieve complete sealing of the volume of the cartridge from its surroundings. On the other hand, such cartridges have the disadvantage that, after opening thereof, they can be closed only objectionably, if at all. Thus, depending on the substance, a time period in which the cartridge is capable of use after opening is greatly limited. For example, adhesives or sealants can cure through contact with moisture in the cartridge and are thus no longer able to be used.

Moreover, metering and/or use of such cartridges customarily requires a cartridge gun or other auxiliary devices in order to convey the substance from the cartridge.

Alternative receptacles to such closed cartridges are receptacles having valves. In certain embodiments, these receptacles are under pressure, with the result that a substance flows out of the receptacle upon opening the valve. A valve for such a receptacle is disclosed in WO 2012/024290 A1, for example. For application of the substance, nozzles can again be arranged over the valve.

Such receptacles having valves offer the advantage that the substance can be applied without further manipulations of the receptacle by simple opening of the valve. Moreover, after application, the receptacle can be closed again by the valve, with the result that such a receptacle remains usable for longer after a first opening of the valve.

However, a disadvantage with such receptacles is that storability prior to the first opening or use of the receptacle is not sufficient for all substances and applications. It has been observed that in particular adhesives or sealants, which are water-curing, cannot be stored for a sufficiently long time in such receptacles. In this case, moisture from the surrounding air penetrates through the seal of the valve into the volume of the receptacle, and the adhesive or sealant at least partially cures in the process and can then not be applied as intended. Here, the seals of customary valves are made of rubber.

An object of the present invention thus consists in avoiding the disadvantages of the known devices. In this regard, a storable, simply usable and in addition cost-effective receptacle for storing substances is intended to be made available. Moreover, a method for sealing a receptacle is intended to be made available which can be carried out with simple and cost-effective means.

This object is first of all achieved by a receptacle for storing a substance, wherein the receptacle comprises a cartridge and a valve. Here, a valve inner side is covered by a sealing element, with the result that a receptacle volume is substantially delimited by the cartridge and the sealing element.

This solution offers the advantage that conventional cartridges and valves can be used in order to produce a storable receptacle. Such conventional components are cost-effective and moreover have proved themselves well in practice. Here, to improve the storability, use is made of only a simple and cost-effective sealing element in order to cover and thus to seal the inner side of the valve. This sealing element prevents a situation in which moisture from the surrounding air can penetrate through the valve into the receptacle volume. The storability can thus be greatly increased.

This solution combines the advantages of closed cartridges with the advantages of receptacles having valves. The sealing element affords a storability as is customary in the case of closed cartridges, and the valve affords a user-friendliness as is customary in the case of receptacles having valves.

During a first use of the receptacle, i.e. during a first opening of the valve, the sealing element is broken or torn or displaced, with the result that the substance can flow out through the valve. When closing the valve, the sealing element remains in the broken or torn or displaced state and therefore no longer offers any additional sealing. This means that, after the first use of the receptacle, the storability is reduced by comparison with a state prior to the first use, and the substance has to be applied within a certain time period.

The fact that a valve inner side is covered by a sealing element, with the result that a receptacle volume is substantially delimited by the cartridge and the sealing element, means in the context of this invention that at least those parts of the valve which allow a certain substance exchange between receptacle volume and outside volume are covered by the sealing element. This can concern, for example, a plunger and a seal of the valve. However, a housing and/or a fastening element of the valve cannot be affected, for example. Thus, in this exemplary embodiment, at least the plunger and the seal would be covered on the valve inner side by the sealing element; here, the housing and/or the fastening element can likewise be covered on the valve inner side by the sealing element or else be exposed. Thus, the term "substantially" refers in this context to functionally essential constituent parts of the valve, namely not completely tight constituent parts of the valve.

In an advantageous exemplary embodiment, the receptacle is under pressure, with the result that the substance flows out of the receptacle upon an actuation of the valve. This has the advantage that no auxiliary means thus have to be used to drive out the substance, such as, for example, cartridge guns. Consequently, user-friendliness of the receptacle is thus improved. Moreover, this has the advantage that the sealing element is pressed against the valve inner side by the pressure in the receptacle, with the result that improved sealing of the valve by the sealing element is achieved.

In an advantageous exemplary embodiment, an adhesive or sealant, in particular an adhesive or sealant containing polyurethane, is arranged for storage in the receptacle. This has the advantage that the properties of the receptacle according to the invention can thus be ideally used. Up until now, such products had to be stored either in storable receptacles with reduced user-friendliness or in user-friendly receptacles with reduced storability.

In an advantageous exemplary embodiment, the sealing element is a foil, in particular an aluminum foil. Foils have the advantage that they can assume different shapes. It is thus possible for different types of valves to be sealed with such foils. Aluminum has the advantage that it is an ideal barrier to moisture, that it is cost-effective, that it maintains an assumed shape, and that it is sufficiently robust and at the same time tears under an intended action of force by the valve.

In an advantageous development, the foil has a thickness between 5 and 30 μm, preferably a thickness between 10 and 20 μm. In a further advantageous development, the foil has a weight between 10 and 50 g/m$^2$, preferably a weight between 20 and 40 g/m$^2$. An aluminum foil having such a thickness of approximately 15 μm and such a weight of approximately 30 g/m$^2$ is, on the one hand, sufficiently robust to remain intact when covering the valve inner side and, on the other hand, a foil dimensioned such tears under the intended action of force by the valve during a first use of the receptacle.

In an advantageous exemplary embodiment, the valve has a housing, a plunger, a through-passage, a seal and a fastening element. In an advantageous development, in a closed state of the valve, the through-passage is closed by the seal, and the plunger is displaceable in the housing in such a way that, in an opened state of the valve, the through-passage forms a connection between the receptacle volume and an outside volume. This has the advantage that such an arrangement makes it possible for cost-effective valves to be used. Moreover, the plunger which is displaceable in the housing has the advantage that the sealing element can be broken or torn or displaced in a simple manner through the first actuation of the valve.

In an advantageous development, the plunger is mounted in the housing while being loaded by a spring. This has the advantage that, after an actuation, the valve is passed immediately again into its closed state in that the plunger is returned relative to the housing by the spring.

In an advantageous exemplary embodiment, the seal is formed from rubber. This has the advantage that cost-effective components can thus be used and that sufficiently good sealing is achieved after a first use of the receptacle.

In an advantageous exemplary embodiment, in a stored state of the receptacle, the receptacle volume is sealed from an outside volume by the sealing element and by the seal of the valve, and, in a closed use state of the receptacle, the receptacle volume is sealed from the outside volume only by the seal of the valve, and, in an opened use state of the receptacle, the receptacle volume is connected to the outside volume by a through-passage of the valve.

The set object is additionally achieved by a method for sealing a receptacle having a cartridge and a valve, the method comprising the following steps: providing a sealing element; shaping the sealing element; covering the valve inner side with the shaped sealing element; and fastening the valve with the sealing element to the cartridge, with the result that a receptacle volume is substantially delimited by the cartridge and the sealing element.

This method can be implemented with simple devices and means and allows the production of a receptacle having the same advantages as have already been stated in relation to the receptacle according to the invention.

In an advantageous exemplary embodiment, a piece of aluminum foil is provided when providing the sealing element. In an advantageous development, a circular foil piece is provided. In an advantageous development, the circular foil piece has a diameter between 3 and 15 cm, preferably between 5 and 10 cm. This has the advantage that sealing elements can thus be shaped with a small material use of the foil.

In an advantageous exemplary embodiment, when shaping the sealing element, the sealing element is placed by a first shaping element over a second shaping element, with the result that the sealing element assumes a shape of the second shaping element, wherein the second shaping element has a substantially part-ball-like shape. This has the advantage that it is thus possible to produce spherically shaped sealing elements which can be simply arranged on the valve inner side to cover the valve.

In an advantageous exemplary embodiment, the method comprises the following step: subjecting the receptacle to pressure, with the result that a substance flows out of the receptacle upon an actuation of the valve, and with the result that the sealing element is pressed onto the valve inner side. On the one hand, this has the advantage that a high degree of user-friendliness is thus achieved. On the other hand, the pressure affords improved sealing of the valve because the pressure in the receptacle presses the sealing element against the valve inner side. In the case of foil-like sealing elements, this can advantageously lead to the sealing element being shaped onto the contours of the valve inner side, which furthermore improves the sealing of the valve by the sealing element.

In an advantageous exemplary embodiment, the receptacle is formed in the method according to the advantageous described exemplary embodiments and developments.

Figure 2A:
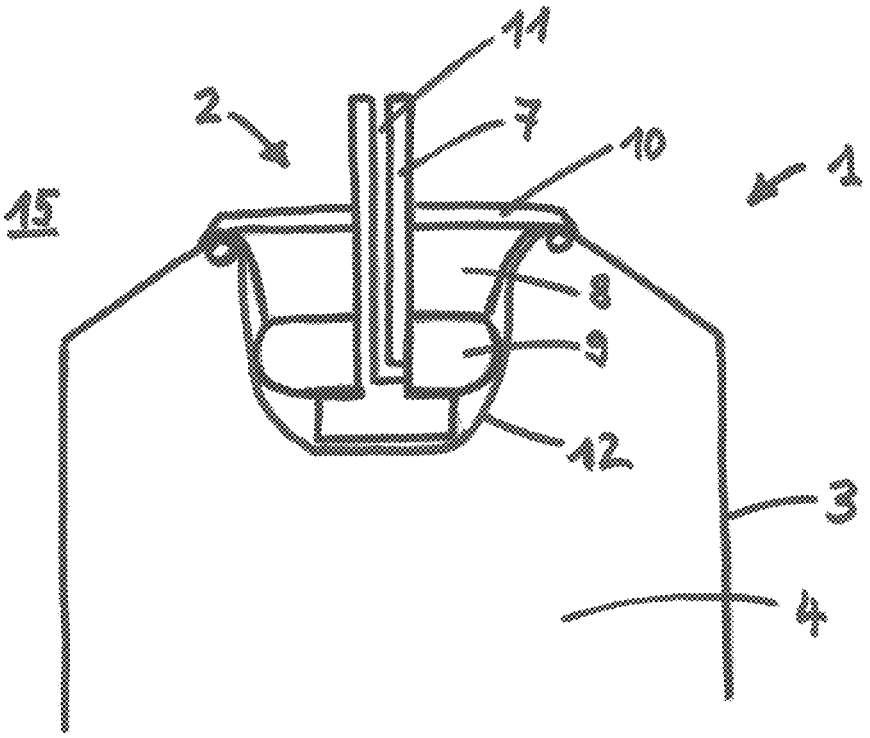
Figure 2B:
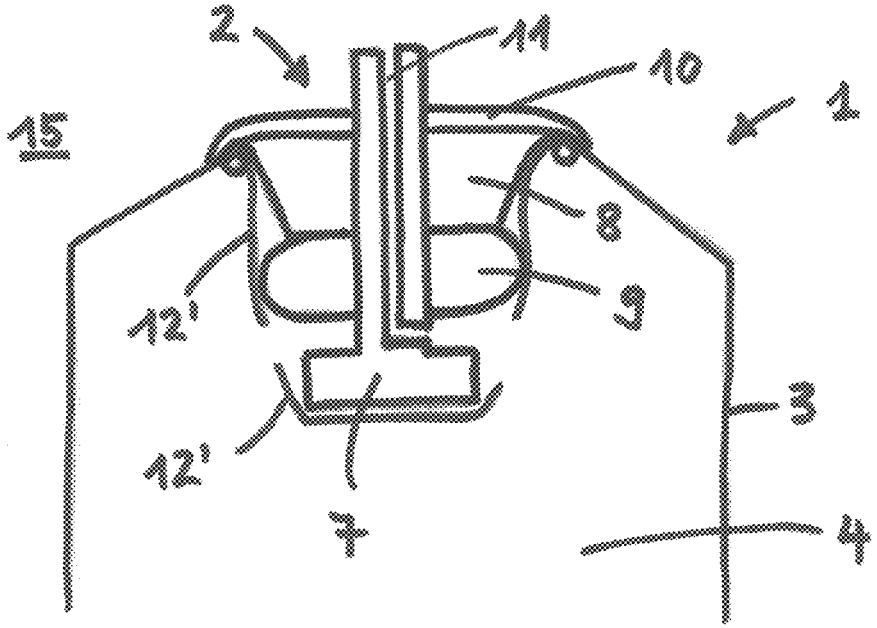

Details and advantages of the invention will be described hereinbelow on the basis of exemplary embodiments and with reference to schematic drawings, in which:

FIG. 1 shows an exemplary receptacle comprising a cartridge and a valve according to the prior art;

FIG. 2*a* shows a schematic illustration of an exemplary receptacle having a covered valve in a storage state;

FIG. 2*b* shows a schematic illustration of an exemplary receptacle having a covered valve in an opened use state; and FIGS. 3*a*-3*i* show a method for sealing a receptacle having a cartridge and a valve An exemplary receptacle 1 according to the prior art having a cartridge 3 and a valve 2 is illustrated in FIG. 1. The cartridge 3 and the valve 2 delimit a receptacle volume 4 with respect to an outside volume 15. The valve has a valve outer side 5 which adjoins the outside volume 15, and a valve inner side 6 which adjoins the receptacle volume 4.

Such receptacles 1 are for example under pressure, with the result that, when opening the valve 2, a substance which is stored in the receptacle 1 flows into the outside volume 15 through the valve 2.

A disadvantage of such solutions is the limited storability for certain substances, such as, for example, polyurethane-containing adhesives or sealants which are water-curing. Customary valves 2 are sealed by a seal made of rubber. However, such seals are not perfectly tight, with the result that certain amounts of water from the outside volume 15 pass through the seal to the receptacle volume 4, where the water-curing adhesive or sealant begins to cure. Consequently, after a certain storage time, the substance can no longer be used as intended.

FIGS. 2*a* and 2*b* each illustrate a section through a schematic and exemplary receptacle 1 having a cartridge 3, a valve 2 and an additional sealing element 12 which covers the valve inner side 6. Here, the receptacle 1 in FIG. 2*a* is illustrated in a storage state and the receptacle 1 in FIG. 2*b* is illustrated in an opened use state.

The valve 2 comprises a housing 8, a plunger 7, a through-passage 11, a seal 9 and a fastening element 10. The fastening element 10 serves to connect and/or fasten the valve 2 to the cartridge 3. The housing 8 is arranged on the fastening element 10. The plunger 7 is arranged so as to be displaceable in and relative to the housing 8. Here, the plunger 7 is displaceable from a closed position into an opened position. In this exemplary embodiment, the through-passage 11 is arranged as a duct in the plunger 7. The seal 9 is arranged around the plunger 7 in such a way that, in the closed position of the plunger 7, the through-passage 11 is sealed by the seal 9 and that, in the open position of the plunger 7, the through-passage 11 connects the receptacle volume 4 to the outside volume 15.

In FIG. 2*a*, the sealing element 12 is in an intact state, with the result that the receptacle volume 4 is effectively sealed with respect to the valve 2 by the sealing element 12. In FIG. 2*b*, the sealing element 12' is in a torn state, with the result that a substance can flow from the receptacle volume 4 through the through-passage 11 of the valve 2 into the outside volume 15. Here, the sealing element 12 is torn during a first opening of the valve 2. The displacement of the plunger 7 subjects the sealing element 12 to a force, causing it to tear. In a closed use state (not shown), the valve 2 is closed and the sealing element 12' is in a torn state, with the result that the receptacle volume 4 is sealed from the outside volume 15 only by the seal 9 of the valve 2. Therefore, the storability of the receptacle 1 with the substance contained therein is limited in a closed use state.

FIGS. 3*a* to 3*i* illustrate a method for sealing a receptacle 1 having a cartridge 3 and a valve 2.

First of all, the sealing element 12 is provided.

Figure 3A:
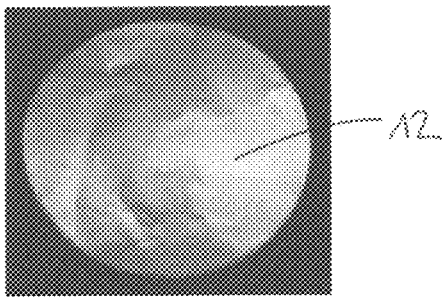

FIG. 3*a* shows a provided sealing element 12. In this exemplary embodiment, the sealing element 12 is a circular piece of foil. In a preferred exemplary embodiment, use is made of an aluminum foil having a thickness of approximately 15 μm and a weight of approximately 30 g/m$^2$. Here, the circular piece has a diameter of approximately 70 mm. Such pieces can be cut out of a larger foil, for example using a cutting mold.

The sealing element 12 is then shaped.

Figure 3B:
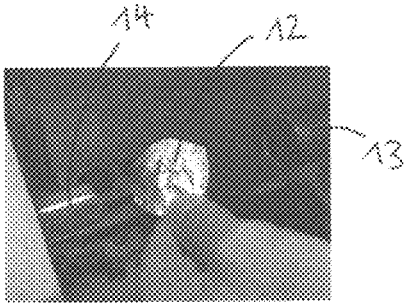
Figure 3C:
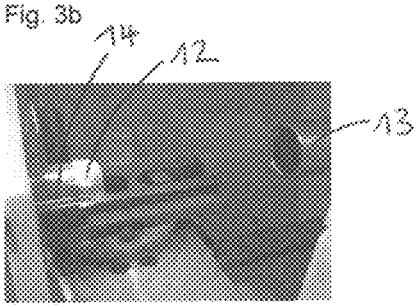

FIGS. 3*b* and 3*c* show a shaping of the sealing element 12. Here, the sealing element 12 is placed by a first shaping element 13 over a second shaping element 14. In this exemplary embodiment, the sealing element 12 is subjected to suction by the second shaping element 14. The first and the second shaping element 13, 14 are then offset with respect to one another, with the result that the sealing element 12 assumes a shape of an interspace between the shaping elements 13, 14. In this exemplary embodiment, the second shaping element 14 has a substantially part-ball-like shape, and the first shaping element 13 has a substantially cylindrical shape.

Figure 3D:
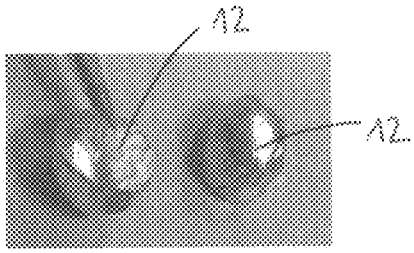

FIG. 3*d* shows two shaped sealing elements 12, with the sealing elements 12 being oriented differently in space. Here, the part-ball-like shape of the sealing elements 12 is visible.

The valve inner side is then covered with the preshaped sealing element 12.

Figure 3E:
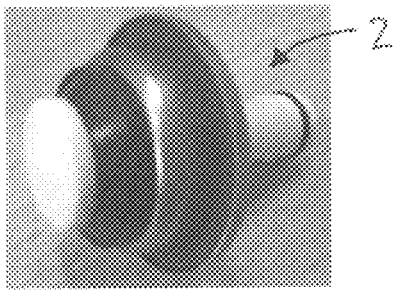
Figure 3F:
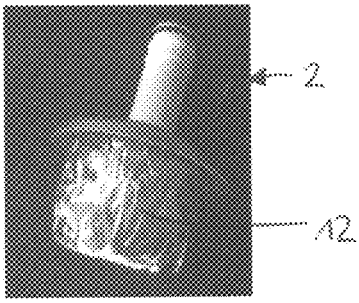

FIG. 3*e* shows a valve 2 without sealing element 12. FIG. 3*f* shows the same valve 2 as in FIG. 3*e*, but with a sealing element 12 arranged on the valve inner side. Here, the sealing element 12 covers the plunger, the seal and the housing on the valve inner side. Only the fastening element of the valve 2 is not completely covered by the sealing element 12.

Finally, the valve 2 with the sealing element 12 is fastened to the cartridge 3, with the result that a receptacle volume 4 is substantially delimited by the cartridge 3 and the sealing element 12.

Figure 3G:
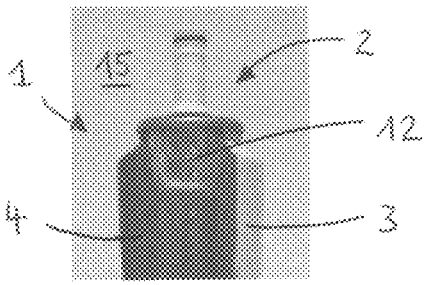
Figure 3H:
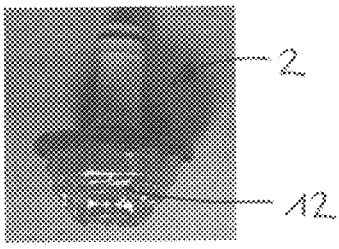

FIG. 3*g* shows the valve 2 with the sealing element 12 fastened to the cartridge 3. The receptacle volume 4 is now substantially delimited by the cartridge 3 and the sealing element 12. If the cartridge 3 and the sealing element 12 are formed from aluminum, the entire receptacle volume 4 can thus be sealed from the outside volume by aluminum elements. Very good storability with at the same time a high degree of user-friendliness is thus achieved.

In a preferred development, the receptacle 1 is subjected to pressure, with the result that a substance flows out of the receptacle 1 upon actuation of the valve 2, and with the result that the sealing element 12 is pressed onto the valve inner side.

FIG. 3*g* shows a valve 2 with a sealing element 12 pressed onto the valve inner side. It is visible here how the sealing element 12 has assumed the contours of the valve inner side. Pressurizing the receptacle 1 in such a way affords improved sealing by the sealing element 12 because the sealing element 12 is thus better shaped onto the valve and the valve 2 is consequently better sealed with respect to the receptacle volume 4. FIG. 3*g* shows a valve 2 in a storage state.

Figure 3I:
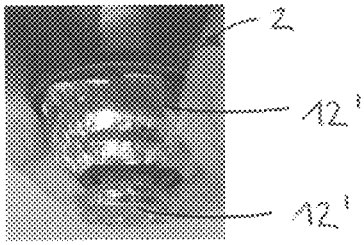

FIG. 3*i* shows a valve 2 with a sealing element 12' in a torn state arranged thereon. Here, the valve 2 is in an opened use state. Consequently, a substance stored in the receptacle 1 can flow from the receptacle volume 4 through the valve 2 into the outside volume 15.

In a closed use state (not shown), the receptacle volume 4 is sealed from the outside volume 15 only by the seal of the valve 2. The sealing element 12' remains torn in a use state irrespective of whether the valve 2 is in an opened or in a closed position. Thus, storability of the substance stored in the receptacle 1 is lower in a use state of the sealing element 12' than in a storage state of the sealing element 12.

The invention claimed is:

1. A receptacle for storing a substance, the receptacle comprising a cartridge and a valve, wherein a side of the valve within the cartridge is covered by a sealing element, with the result that a receptacle volume is delimited by the cartridge and the sealing element, wherein in a storage state of the receptacle, the receptacle volume is sealed from an outside volume by the sealing element and by a seal of the valve, and the sealing element surrounds the valve within the cartridge, such that the valve is separated from the receptacle volume by the sealing element, in a closed use state of the receptacle, the receptacle volume is sealed from the outside volume only by the seal of the valve, and in an opened use state of the receptacle, the receptacle volume is connected to the outside volume by a through-passage of the valve.

2. The receptacle as claimed in claim 1, wherein the receptacle is under pressure, with the result that the substance flows out of the receptacle upon an actuation of the valve.

3. The receptacle as claimed in claim 1, wherein an adhesive or sealant is arranged for storage in the receptacle.

4. The receptacle as claimed in claim 1, wherein the sealing element is a foil.

5. The receptacle as claimed in claim 1, wherein the foil has a thickness of 5 to 30 μm.

6. The receptacle as claimed in claim 1, wherein walls of the cartridge are formed from metal.

7. The receptacle as claimed in claim 1, wherein the valve has a housing, a plunger, a through-passage, a seal and a fastening element.

8. The receptacle as claimed in claim 7, wherein, in a closed state of the valve, the through-passage is closed by the seal, and wherein the plunger is displaceable in the housing in such a way that, in an opened state of the valve, the through-passage forms a connection between the receptacle volume and an outside volume.

9. The receptacle as claimed in claim 7, wherein the seal is formed from rubber.

10. A method for sealing a receptacle having a cartridge and a valve, the method comprising the following steps:

providing a sealing element;

shaping the sealing element;

covering a side of the valve within the cartridge with the shaped sealing element; and fastening the valve with the sealing element to the cartridge, with the result that a receptacle volume is delimited by the cartridge and the sealing element, and the sealing element surrounds the valve within the cartridge, such that the valve is separated from the receptacle volume by the sealing element.

11. The method as claimed in claim 10, wherein a piece of aluminum foil is provided when providing the sealing element.

12. The method as claimed in claim 10, wherein, when shaping the sealing element, the sealing element is placed by a first shaping element over a second shaping element, with the result that the sealing element assumes a shape of the second shaping element, wherein the second shaping element has a part-ball-like shape.

13. The method as claimed in claim 10, wherein the method comprises the following step:

subjecting the receptacle to pressure, with the result that a substance flows out of the receptacle upon an actuation of the valve, and with the result that the sealing element is pressed onto the side of the valve within the cartridge.

14. The method as claimed in claim 10, wherein the receptacle is formed for storing a substance, the receptacle comprising a cartridge and a valve, wherein the side of the valve within the cartridge is covered by a sealing element, with the result that a receptacle volume is delimited by the cartridge and the sealing element.

15. A receptacle for storing a substance, the receptacle comprising a cartridge and a valve, wherein a side of the valve within the cartridge is covered by a sealing element, with the result that a receptacle volume is delimited by the cartridge and the sealing element, wherein in a storage state of the receptacle, the receptacle volume is sealed from an outside volume by the sealing element and by a seal of the valve, and the receptacle volume is completely delimited by a single boundary set by the cartridge and the sealing element, in a closed use state of the receptacle, the receptacle volume is sealed from the outside volume only by the seal of the valve, and in an opened use state of the receptacle, the receptacle volume is connected to the outside volume by a through-passage of the valve.

* * * * *